US007249963B2

(12) United States Patent
Ramm

(10) Patent No.: US 7,249,963 B2
(45) Date of Patent: Jul. 31, 2007

(54) SCREWLESS CONNECTION FRAME TERMINAL

(75) Inventor: Andreas Ramm, Kirchhundem (DE)

(73) Assignee: Bals Elektrotechnik GmbH & Co. KG (DE)

( * ) Notice: Subject to any disclaimer, the term of this patent is extended or adjusted under 35 U.S.C. 154(b) by 0 days.

(21) Appl. No.: 11/456,641

(22) Filed: Jul. 11, 2006

(65) Prior Publication Data

US 2007/0006558 A1 Jan. 11, 2007

(30) Foreign Application Priority Data

Jul. 11, 2005 (DE) ..... 20 2005 010 991 U
Feb. 3, 2006 (EP) ..... 06002211

(51) Int. Cl.
*H01R 11/20* (2006.01)

(52) U.S. Cl. ..... 439/437; 439/835

(58) Field of Classification Search ..... 439/709, 439/711, 712, 713, 437–441, 835–838
See application file for complete search history.

(56) References Cited

U.S. PATENT DOCUMENTS

| | | | | |
|---|---|---|---|---|
| 4,416,500 | A | 11/1983 | Stenz | |
| 5,192,234 | A * | 3/1993 | Heng et al. | 439/806 |
| 5,685,735 | A * | 11/1997 | Hohorst | 439/441 |
| 6,126,494 | A * | 10/2000 | Fuchs et al. | 439/835 |
| 6,336,824 | B1 * | 1/2002 | Sorig | 439/441 |
| 6,464,545 | B2 * | 10/2002 | Yano | 439/828 |
| 6,783,385 | B2 * | 8/2004 | Rudy | 439/438 |
| 6,786,779 | B2 * | 9/2004 | Feldmeier et al. | 439/729 |
| 6,832,938 | B2 * | 12/2004 | Lenker | 439/835 |
| 6,893,286 | B2 * | 5/2005 | Drewes et al. | 439/441 |
| 7,004,781 | B2 * | 2/2006 | Walter | 439/441 |
| 7,104,833 | B2 * | 9/2006 | Oesterhaus | 439/441 |
| 7,115,001 | B1 * | 10/2006 | Brockman et al. | 439/828 |
| 2002/0187670 | A1 * | 12/2002 | Cisey | 439/441 |
| 2005/0079773 | A1 * | 4/2005 | Prokup et al. | 439/709 |
| 2006/0128206 | A1 * | 6/2006 | Oesterhaus | 439/441 |

FOREIGN PATENT DOCUMENTS

| | | |
|---|---|---|
| DE | 1 065 507 B | 9/1959 |
| DE | 1 762 619 | 6/1971 |
| DE | 30 42 057 A1 | 5/1982 |
| DE | 80 29 790 U1 | 3/1983 |

(Continued)

*Primary Examiner*—Ross Gushi
(74) *Attorney, Agent, or Firm*—DeMont & Breyer, LLC

(57) ABSTRACT

The invention relates to a screwless connection terminal having a contact part having a connection section to which a conductor can be electrically connected, a clamping spring, a metallic frame which surrounds the clamping spring and is designed to be inserted into insulating housing means of an electrical apparatus, and an actuating element for the clamping spring, the frame also at least partially accommodating the connection section, and the clamping spring in accordance with one embodiment having a leg for the purpose of moving the frame in relation to and transverse to the connection section in order to clamp the conductor to be connected between the frame and the connection section, a blocking device in a blocking position holding the frame in a position in which the clamping spring is prestressed, and the actuating element being in the form of a release device, which is capable of releasing the blocking position for the frame in order to bring the leg into action.

33 Claims, 9 Drawing Sheets

FOREIGN PATENT DOCUMENTS

Figure 1:
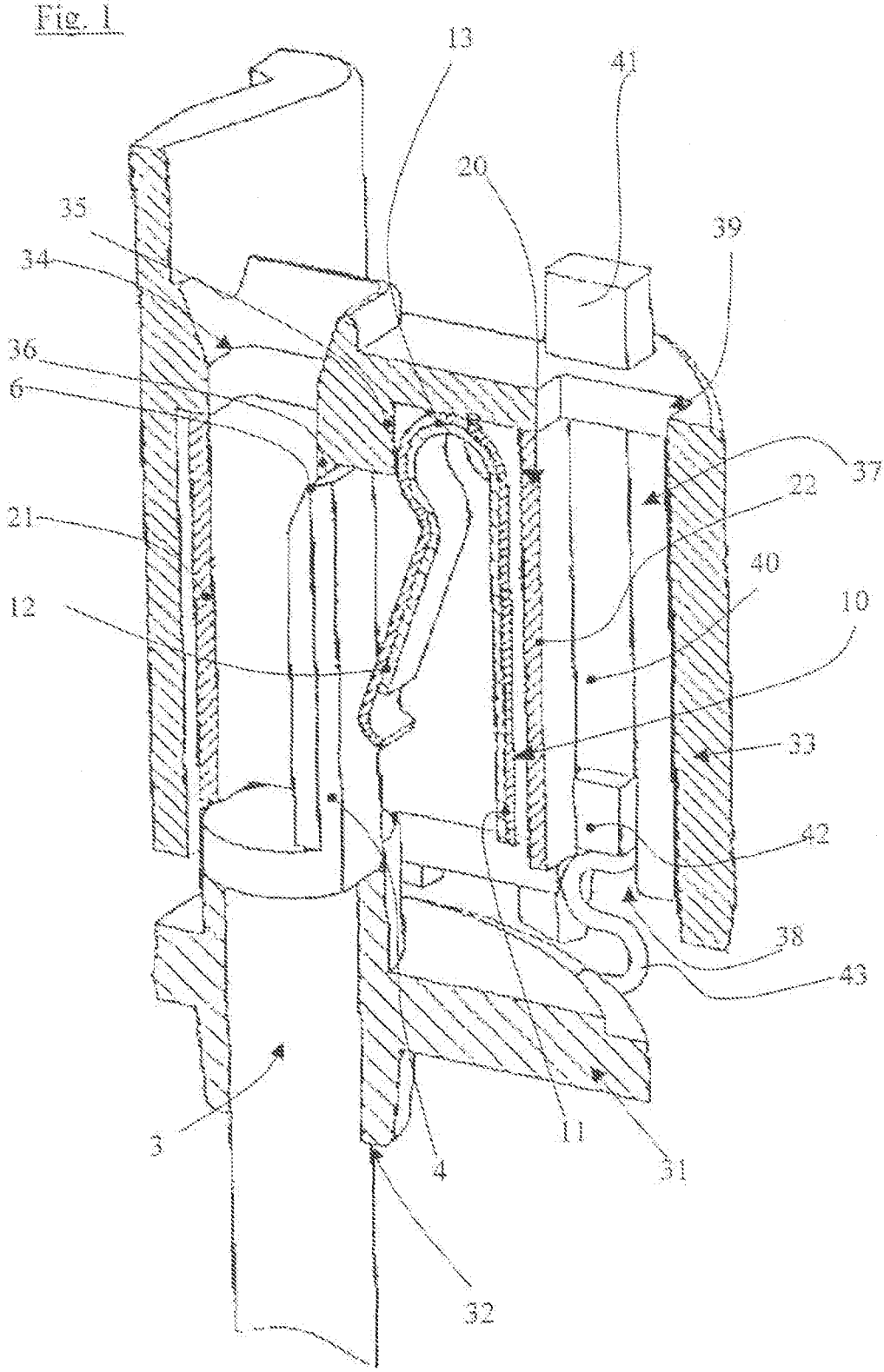

| | | | |
|---|---|---|---|
| DE | 34 02 870 | A1 | 8/1985 |
| DE | 3406081 | A1 | 8/1985 |
| DE | 38 18 548 | A1 | 7/1989 |
| DE | 42 31 244 | A1 | 3/1994 |
| DE | 203 08 863 | U1 | 9/2003 |
| DE | 20 2004 418 | U1 | 7/2005 |
| EP | 0 871 243 | A1 | 10/1998 |
| EP | 1 555 723 | A1 | 7/2005 |

* cited by examiner

SCREWLESS CONNECTION FRAME TERMINAL

The invention relates to a screwless connection terminal having the features of the preamble of claim 1 or 9 and to electrical apparatuses having such a connection terminal.

In the case of a screwless connection terminal of this type, as is known, for example, from EP 05 000 570.1, a parallelepipedal metallic frame is provided which surrounds and holds the clamping spring, which has the form of a clasp or annular clasp. The frame and the clamping spring together form a frame terminal. The ends of the annular clasp are in the form of a latching piece and a mating latching piece, i.e. they cooperate in the manner of a latching device and can be latched with one another, in this case the annular clasp being closed. The latching device can be unlatched by means of a release, after which the clamping leg becomes active and presses a conductor, which may have been inserted into the interior of the frame, against the contact part. The contact part can, for this purpose, reach into the interior of the frame from the side opposite the insertion side of the conductor.

In the case of a further screwless connection terminal of this type (DE 203 08 863 U1), a clasp-shaped contact spring is provided, whose contact leg normally bears against the connection section but can be brought into an open position using a slide-like actuating element in order to be able to insert a conductor between the clamping spring and the connection section. Once the actuating element has been released, the clamping spring springs back and clamps in the electrical conductor.

In the case of previously known screwless connection terminals, the conductor to be connected is thus clamped directly between a spring leg and the connection section of the contact part.

This conventionally means that, for the actuation of the clamping spring, an actuating device or a suitable tool always needs to act directly on the clamping spring and it is thus necessary to gain access from the outside to the interior of the frame in which the clamping spring is arranged, it also being necessary in particular to intervene directly between the clamping leg and the conductor in order to remove a clamped conductor again. This may result in wear phenomena which are not visible. Furthermore, the clamping spring leg generally acts with only an extremely small leg section actually on the inserted conductor for clamping purposes.

One object of the invention is to provide a screwless connection terminal which provides a more reliable clamping action for a conductor to be clamped and avoids intervention in the frame interior, within which the clamping spring is held, with the result that wear phenomena on the clamping spring and/or on the inserted conductor, in particular in the case of frequent actuation, are largely ruled out in the inner region which is largely invisible from the outside.

The object is achieved according to the invention in each case by a subject matter having the features of claims 1, 9 or 38.

Advantageous and/or preferred embodiments and developments are the subject matter of the dependent claims.

In the case of a screwless connection terminal, which has a contact part having contact section and having a connection section to which a conductor can be electrically connected, a clamping spring, a metallic frame which surrounds the clamping spring and is designed to be inserted into insulating housing means of an electrical apparatus, in particular a plugging apparatus, and an actuating element for the clamping spring, the frame also at least partially accommodating the connection section, the invention thus provides for the clamping spring to have a part or clamping spring end for the purpose of moving the frame in relation to and transversely to the connection section in order to clamp the conductor to be connected between the frame and the connection section, for a blocking device in a blocking position to hold the frame in a position in which the clamping spring is prestressed, and for the actuating element to be in the form of a release device, which is capable of releasing the blocking position for the frame in order to bring the part or clamping spring end into action.

Since, as a result, the frame is inserted in a housing such that it can be displaced in relation to and transversely to the connection section and is therefore a type of carriage, which prestresses the clamping spring in a first position and clamps in the conductor to be connected in a second position without the clamping spring coming into direct contact with said conductor, as a result tensioning of the clamping spring and release of the clamping action can be controlled directly via the position of the frame which can thus be carried out without any intervention in the frame interior.

In one preferred embodiment, the metallic frame forms, with the clamping spring, one unit which is designed to be inserted in insulating housing means of an electrical apparatus, in order to simplify assembly.

One particularly efficient arrangement of the blocking device is provided if, in the blocking position, said blocking device bears against a side wall of the frame, against which side wall the clamping spring end bears, from the opposite side, and the actuating element is capable of causing the blocking device to be released from the side wall.

In order to again fix the frame in a simple manner in the position in which the clamping spring is prestressed, in accordance with one embodiment the blocking device is expediently connected to a resetting device for the purpose of resetting the blocking device, said resetting device being tensioned by the blocking device being released.

In one preferred development, in particular also for the purpose of reducing the number of components required, the invention provides for the blocking device to be formed on the actuating element.

In order to achieve a situation in which the spring force acts uniformly on the frame, the clamping spring end of the clamping spring bears essentially completely against a side wall of the metallic frame and is preferably fixed to the side wall or is formed integrally with said side wall.

In accordance with one solution, the part or clamping spring end is in the form of a leg.

In accordance with one preferred embodiment, the clamping spring is in the form of a V in longitudinal section and also has, in addition to the clamping leg, a bearing leg to be supported on a supporting device arranged in the frame, the legs preferably merging with one another via a tensioning arc.

In alternative embodiments, a clamping spring is provided, whose spring ends do not necessarily form legs. Provision is thus made, in particular, for at least one helical spring to be used which is essentially cylindrical in the form of a compression spring and of which one end turn acts as a clamping leg and the end turn of the opposite end of the clamping spring acts as a bearing spring leg.

In one further advantageous embodiment, the invention provides for the connection section of the contact part to be used as the supporting device.

In one preferred development, the connection section is accommodated in the frame interior such that, as a result, the interior of the frame is essentially split into two adjacent sub-areas, an area for accommodating the conductor to be connected and an area in which the clamping spring is arranged.

The insulating housing means into which the frame is inserted expediently have a conductor insertion opening, a housing free space for the intervention of the blocking device and a channel, which communicates with the housing free space, for the intervention of the actuating element.

In one preferred embodiment, the housing free space at the same time provides a clearance area in which the clamping spring end is capable of moving the frame when the blocking position is released.

It is advantageous if the housing free space provides a clearance area having a greater width than the maximum movement possible by the frame in relation to and in the direction transverse to the connection section.

In one embodiment according to the invention, the housing free space has an opening from the housing for the intervention of a tool for the purpose of moving the frame out of the housing free space in order to tension the clamping spring.

In one further preferred embodiment, the above mentioned resetting device is arranged between the housing means and the blocking device and can thus be supported in the tensioned state on the housing means and, as a result, can cause the blocking device to be reset to the blocking position when the frame has been moved out of the housing free space.

One preferred embodiment also provides for the actuating element to have an elongate design, from one of whose ends a projection, as the blocking device, reaches into the housing free space, said projection being capable, in the blocking position, of holding the frame in a position counter to the spring force, while the other end of the actuating element extends out of the housing in the form of a pushbutton for the purpose of releasing the blocking position, and being capable of tensioning a spring device, which is connected to the housing means, when the blocking position is released. A channel, which communicates with the housing free space, of the housing has a corresponding opening to the outside and is designed to guide such an actuating element.

In order to hold the clamping spring in a defined position under prestress, the insulating housing means have a bearing shoulder, against which the tensioning arc of a clamping spring bears in the blocking position.

The contact part expediently has a contact section, which is inserted at least partially into insulating housing means outside the frame, with the result that the connection terminal according to the invention has consequently also proved to be advantageous in particular for use in electrical plugging apparatuses.

As an alternative to an actuating element which can be actuated by means of pressure, the actuating element can be guided so as to carry out a rotary movement, by means of which it is possible, overall, to further simplify and improve the operability of the connection terminal. In particular, a blocking device is provided in this case which forms an eccentric surface in relation to the axis of rotation.

Such an actuating element is expediently also guided in a channel which communicates with the housing free space and is formed parallel to the frame side wall, in turn one end of the actuating element extending out of the housing as the actuating member for the purpose of rotating the actuating element in order to release the blocking position, in which a blocking device for holding the frame reaches into the housing free space.

Figure 2:
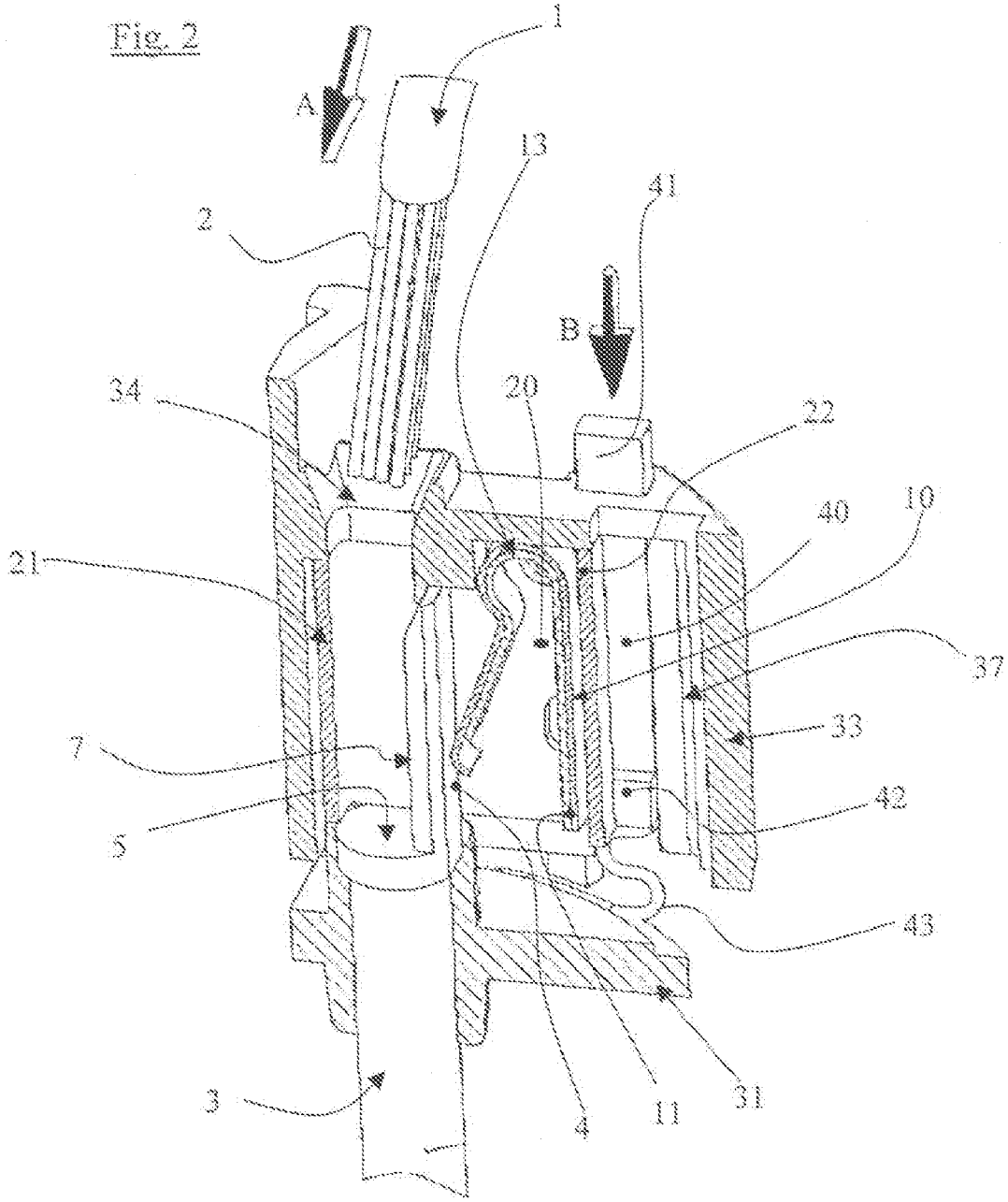
Figure 3:
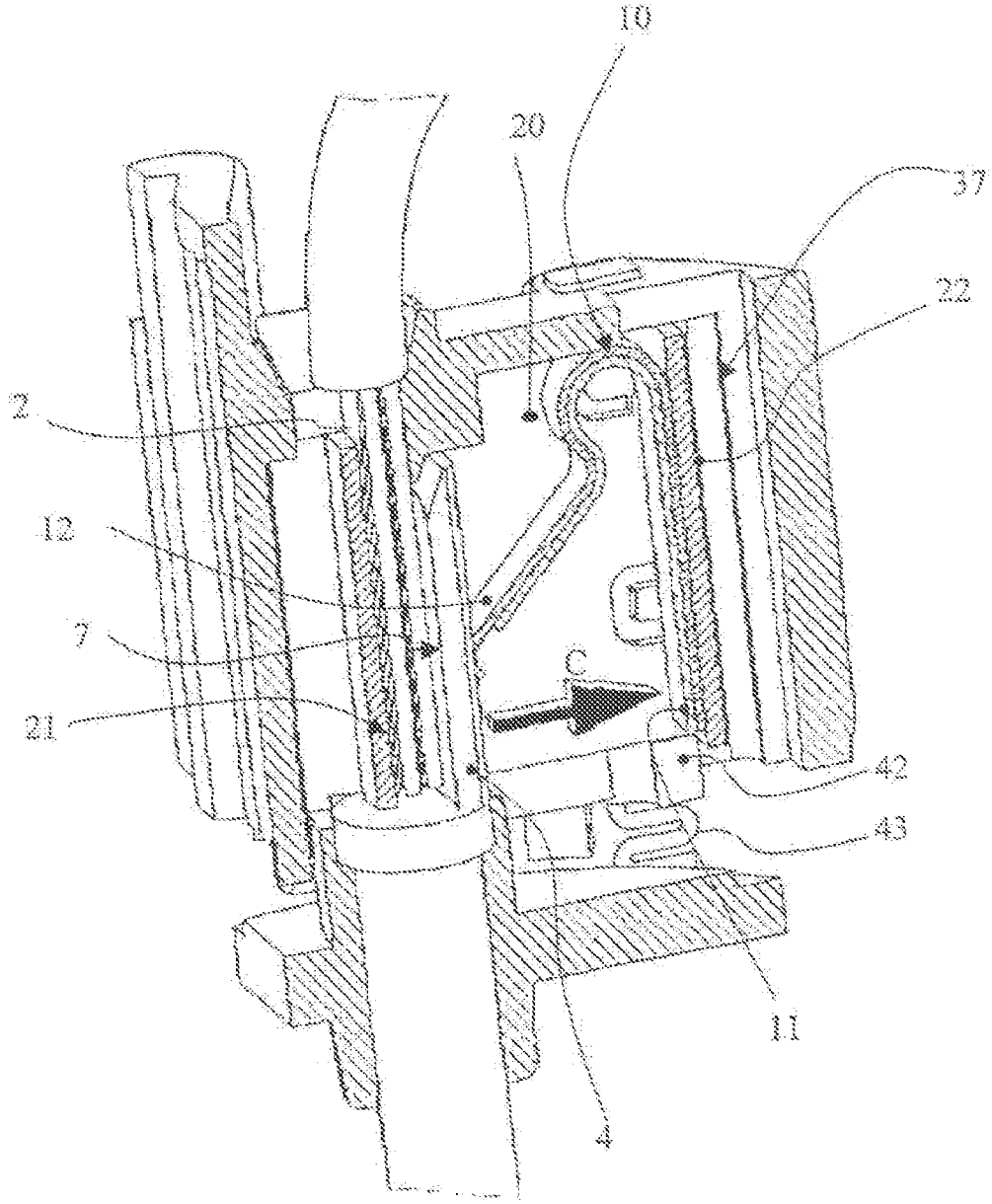
Figure 4:
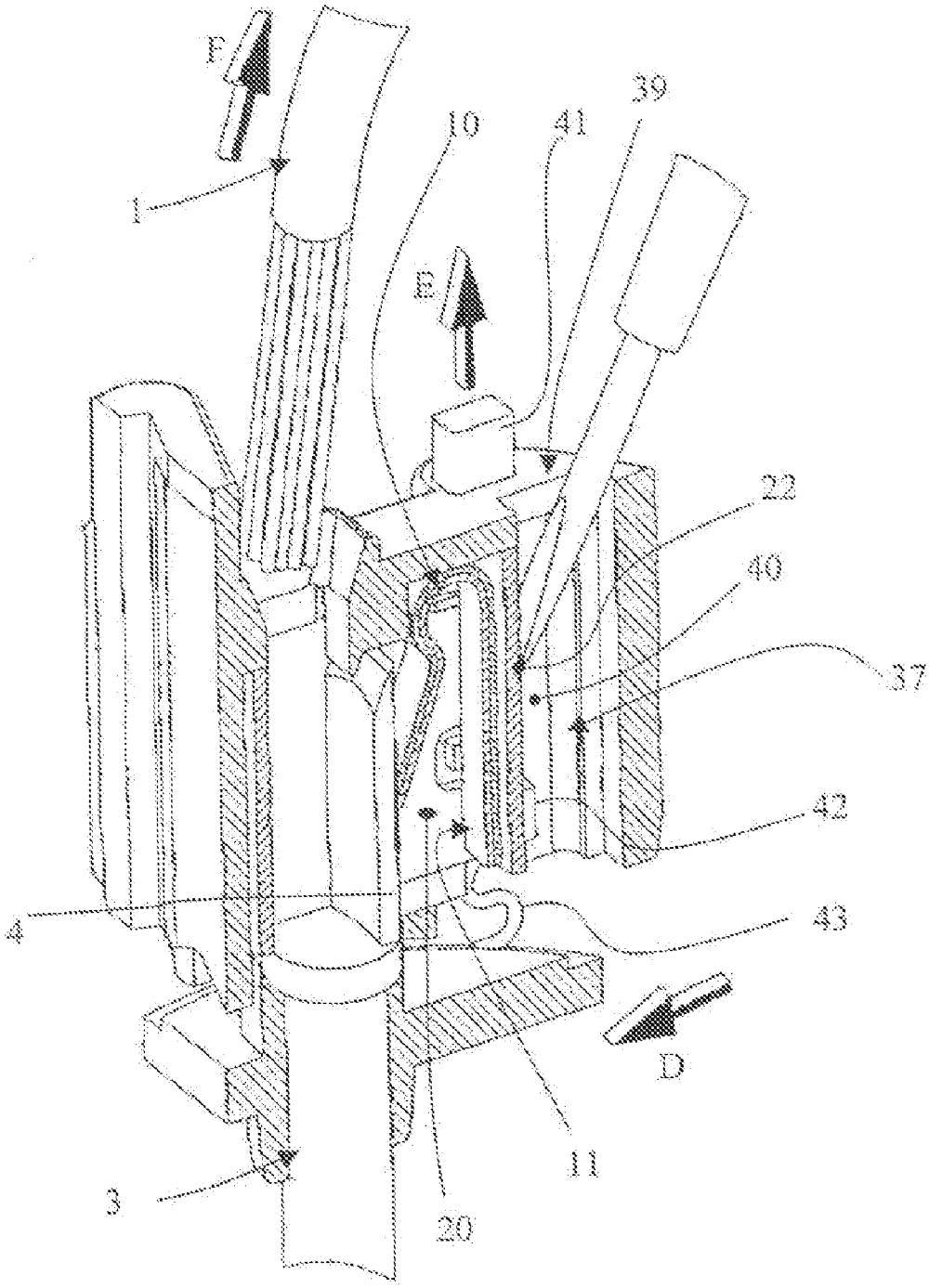
Figure 5:
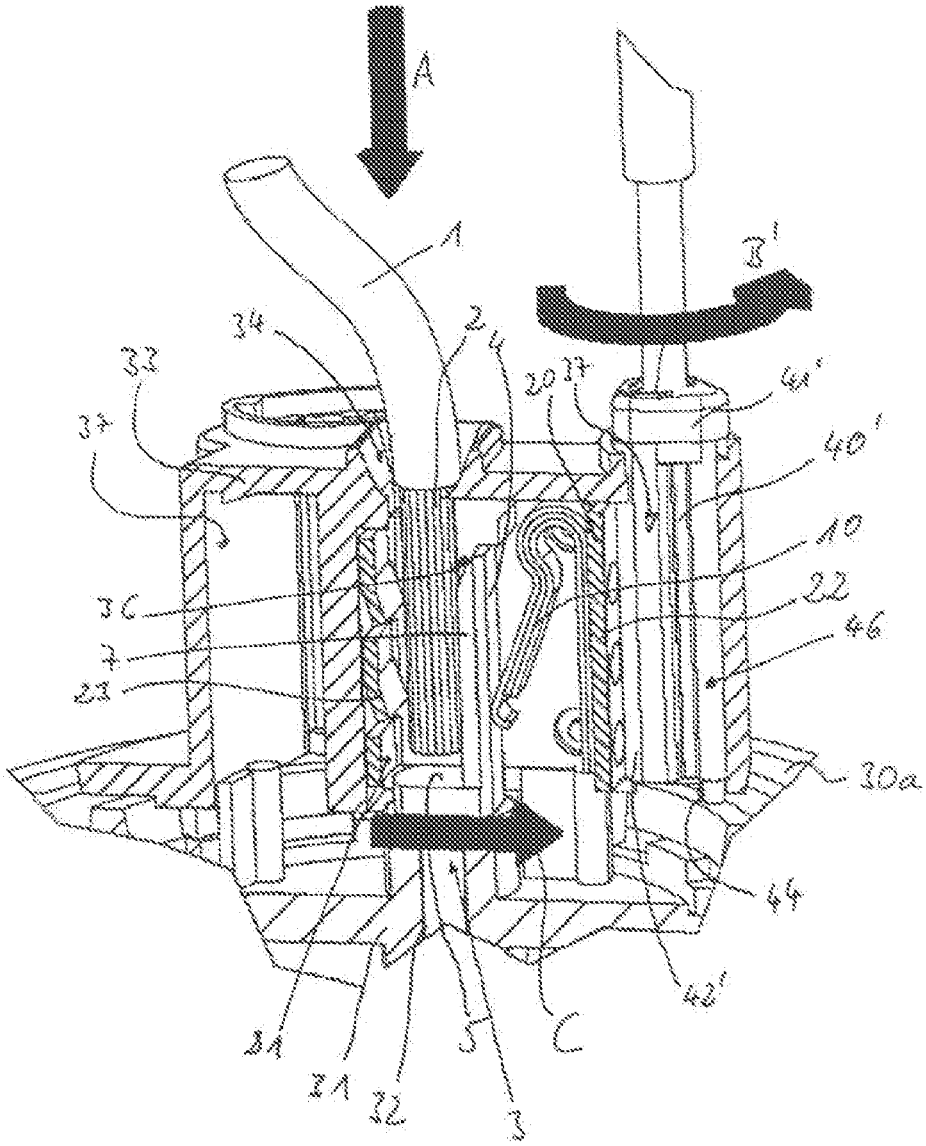
Figure 6:
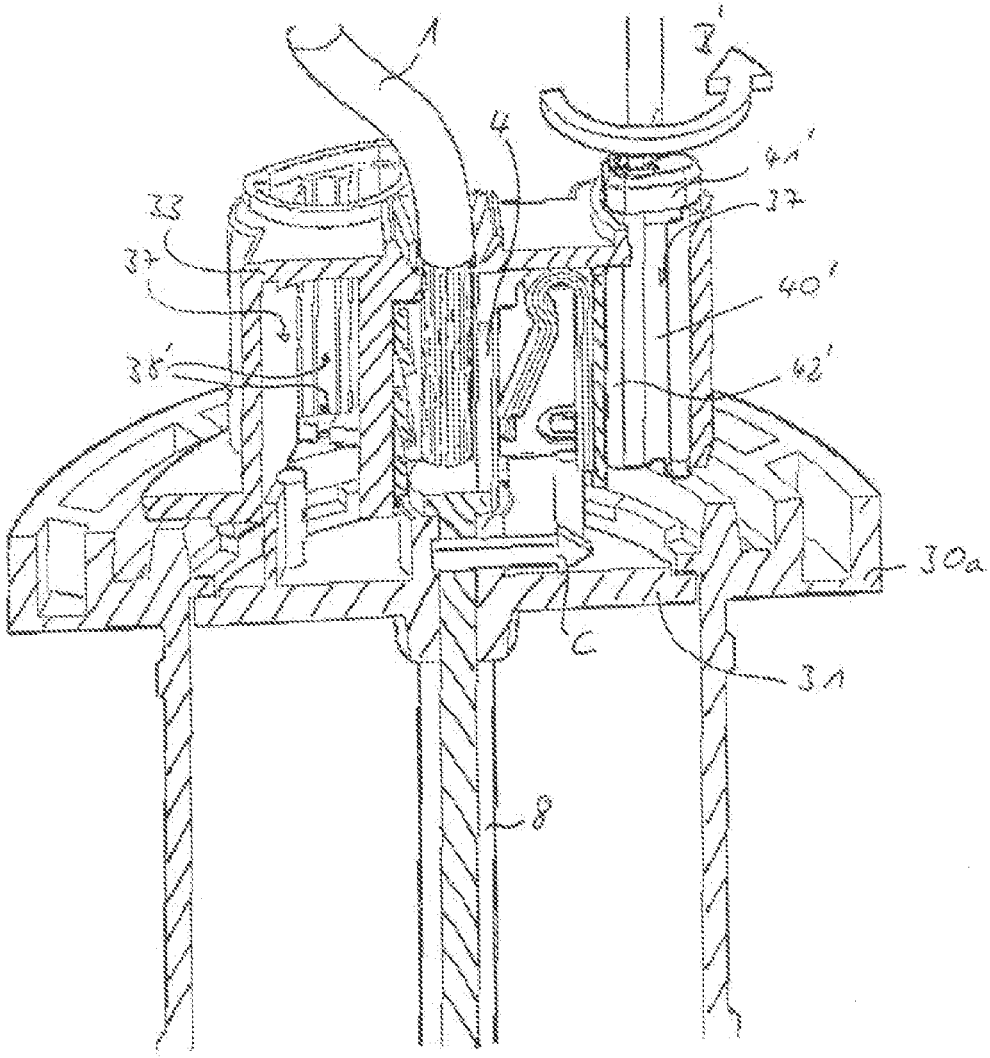
Figure 7:
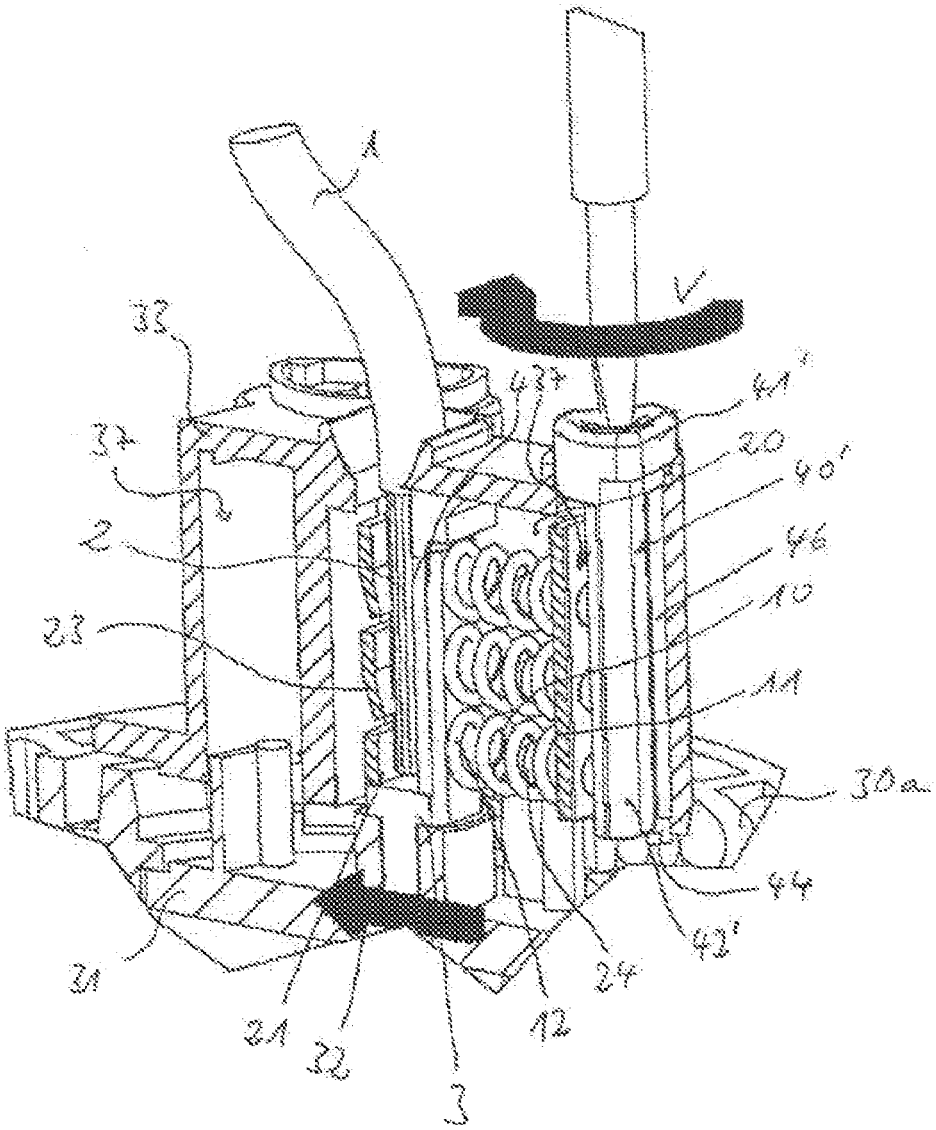
Figure 8:
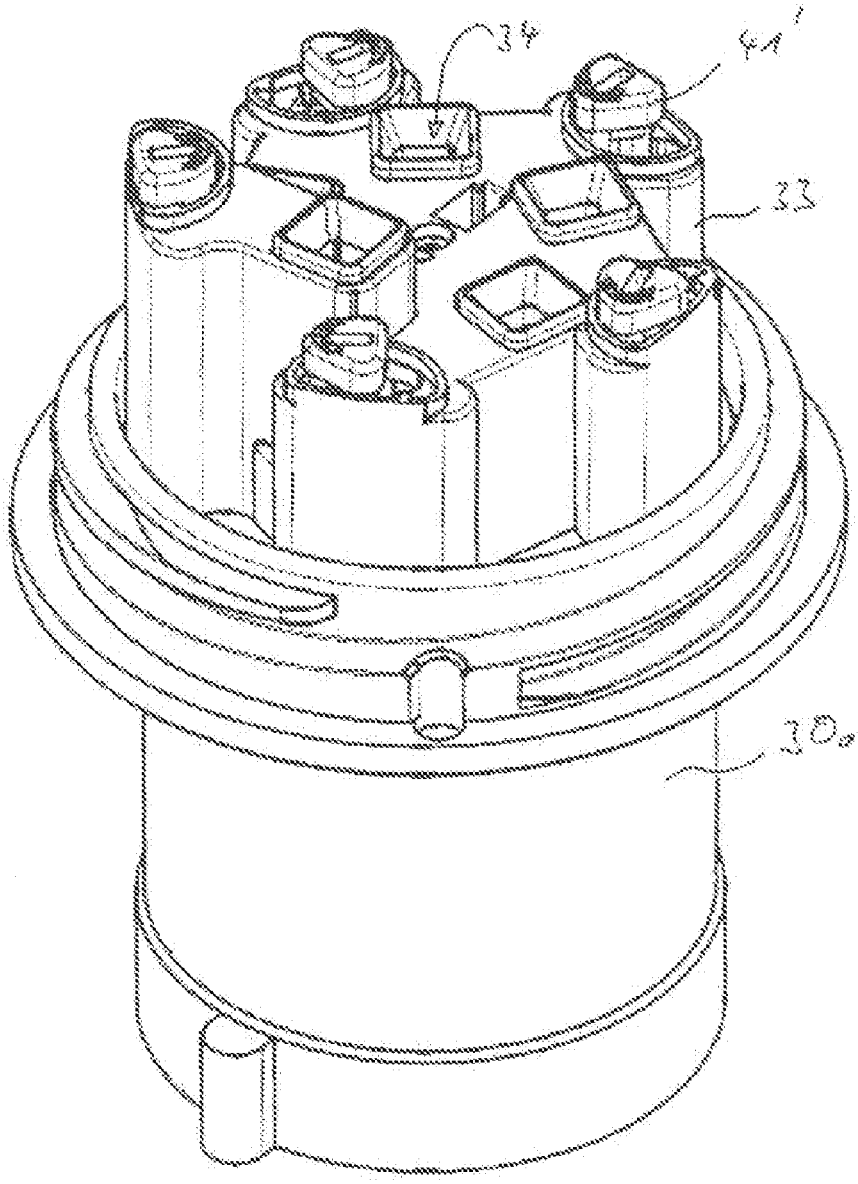
Figure 9:
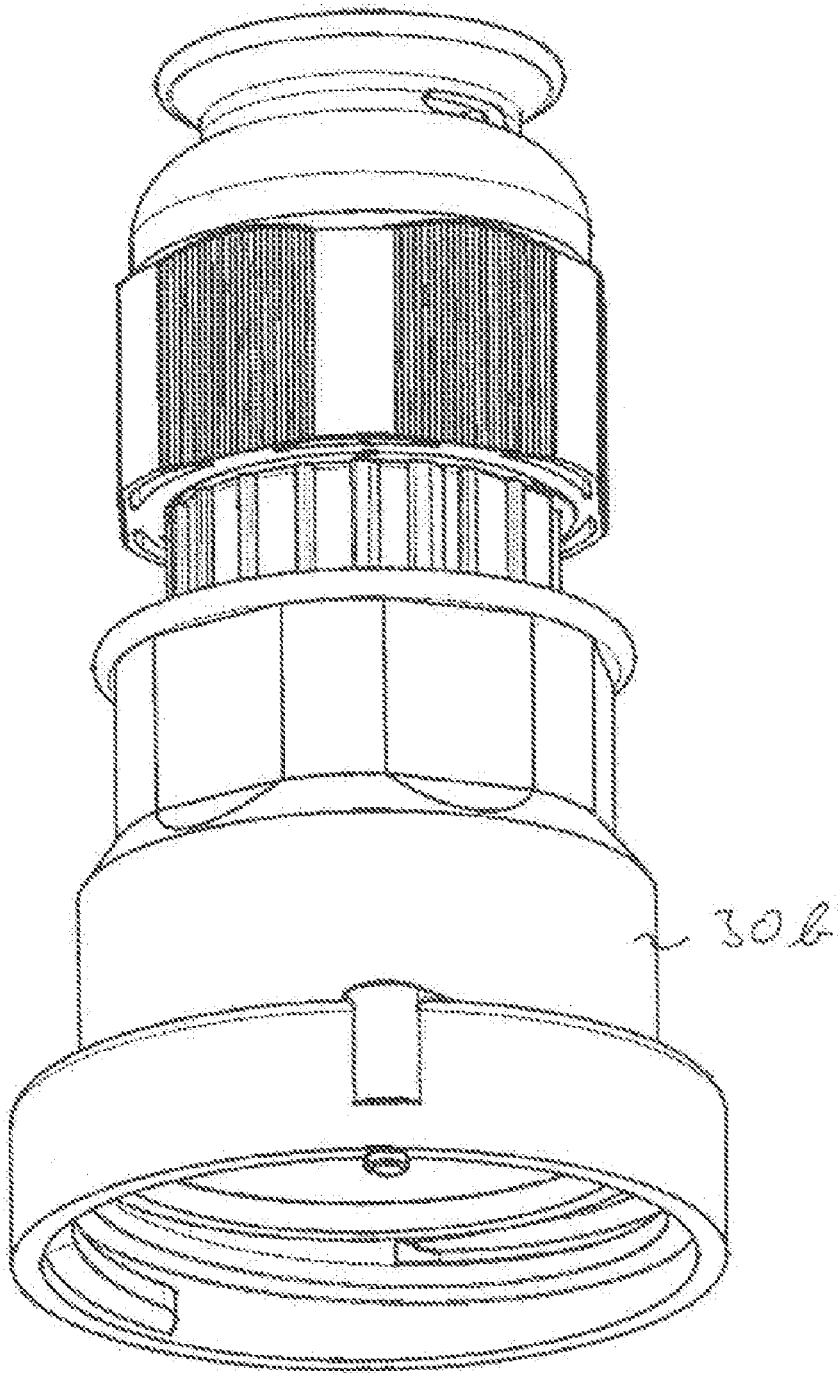

Further advantages and features of the invention will be described in more detail using preferred embodiments with reference to the attached drawing, in which:

FIG. 1 shows a longitudinal section through a housing and a frame terminal of a first embodiment in accordance with the invention and in the prestressed, delivered state, FIG. 2 shows, using the longitudinal section shown in FIG. 1, the manner in which this frame terminal acts so as to connect a conductor, FIG. 3 shows, using the longitudinal section shown in FIG. 1, the manner in which this frame terminal acts with the conductor connected, FIG. 4 shows, using the longitudinal section shown in FIG. 1, the manner in which this frame terminal acts so as to remove the conductor, FIG. 5 shows a cut-open partial view of a second embodiment in accordance with the invention, FIG. 6 shows a cut-open partial view of the embodiment shown in FIG. 5 from a viewing direction which is slightly rotated compared to FIG. 5, FIG. 7 shows a cut-open partial view of a third embodiment in accordance with the invention with the conductor connected, in the case of which, in contrast to the embodiment shown in FIG. 5, end turns of compression springs act as spring legs, and FIGS. 8 and 9 show an external coupling housing having an insert housing, which is arranged therein and accommodates the frame terminal according to the invention, of an electrical plugging apparatus and an external cover housing or hood of the electrical plugging apparatus which can be screwed to the coupling housing.

FIG. 1 shows a cut-open view through a housing which essentially comprises two insulating housing parts 31 and 33 which can be connected to one another, in the view illustrated the lower housing part 31 and the upper housing part 33 being shown in a slightly exploded state in order to illustrate the invention. A frame 20 is arranged within the housing, in turn a clamping spring 10 being held in the interior of said frame 20. The clamping spring 10 is surrounded in a protective manner essentially completely by the metallic frame 20 and partially by the housing.

The frame 20 is formed from a stamped sheet-metal part to give a type of sleeve and determines a frame interior, in which the clamping spring 10 is arranged and in which, at least partially, a contact part 3 and a conductor to be connected to the contact part 3 can be accommodated.

The contact part 3 preferably comprises a connection section 4 for the conductor to be connected and a contact section, which is opposite the connection section 4 and is not illustrated in any more detail, for the purpose of making contact with a mating contact, which contact section may either be in the form of a pin in the case of a socket-shaped mating contact or in the form of a socket in the case of a pin-shaped mating contact. However, reference will be made to the fact that differently shaped contact parts can also be used which have a contact section within the frame.

In the embodiment illustrated, the frame 20 has the shape of a parallelepipedal box, whose upper and lower sides are open, as shown in FIG. 1. The connection section 4 of the contact part 3 and a conductor to be connected to the contact part 3 can thus reach into the interior of the frame from opposite sides.

The housing lower part 31 essentially closes off the frame 20 on its lower open side, and the housing upper part 33 essentially closes off the frame on its upper open side.

The connection section 4 of the contact part 3 is inserted into the frame interior via the lower side, the housing lower part 31 having a correspondingly matched through-opening 32 for the purpose of fixing the contact part 3. The contact part 3 is preferably anchored in the housing lower part 31 within the through-opening 32, and the housing upper part 33 can expediently be plugged, together with the frame terminal, i.e. the clamping spring 10 and the frame 20, onto the housing lower part 31.

As shown in FIG. 1, in the mounted state the connection section 4 is arranged within the frame 20 such that it is spaced apart from two opposite frame side walls 21 and 22. The clamping spring 10 is arranged between the connection section 4 and one frame side wall 22, and an accommodating area for a conductor to be connected to the contact part 3 is defined between the connection section 4 and the other opposite frame side wall 21. The interior of the frame is thus split into two separate sub-areas, a clamping spring area and a conductor-accommodating area, by means of the contact part 3 and the connection section 4.

The frame 20 is held between the upper housing part 33 and the lower housing part 31 such that it can be displaced transversely with respect to the connection section 4, in the position illustrated in FIG. 1, the clamping spring 10 being prestressed and the frame 20 being moved, starting from the frame side wall 21, which is also used to define the accommodating area for the conductor to be connected, in the direction of the connection section 4, i.e. to the right in FIG. 1, when the clamping action unfolds, as described below in detail.

On the housing upper part side, which closes off the upper open side of the frame 20, the housing upper part 33 has a through-opening 34 for the purpose of inserting conductor cores of a conductor to be connected and expediently also has a positioning tab 36, which is essentially aligned with the wall of the through-opening 34 and against which the connection section 4 bears with its free end 6.

In the position of the frame 20 illustrated in FIG. 1, the conductor insertion opening 34 in the housing upper part 33 is located essentially on one axis with the accommodating area between the connection section 4 and the frame side wall 21, the width of the accommodating area and the conductor insertion opening 34 expediently essentially corresponding to one another.

In the present exemplary embodiment, the clamping spring 10 arranged in the clamping spring area has two legs 11 and 12 which are connected to one another via a tensioning arc 13 and are arranged essentially in the form of a V with respect to one another. The spring leg 12 is supported on the connection section 4 of the contact part 3 and thus acts essentially as a bearing leg. The second leg 11, which virtually acts as a clamping leg, bears against the frame side wall 22 and is preferably fixed to said frame side wall 22. In one alternative preferred design, the clamping leg 11 is formed integrally with the frame side wall 22. In the prestressed state shown in FIG. 1, the tensioning arc 13 for the purpose of holding the prestressed clamping spring in a defined manner preferably bears against a bearing shoulder 35 of the housing part 33, which bearing shoulder 35 protrudes into the frame interior from the housing upper part side, which closes off the upper open side of the frame 20.

In the exemplary embodiment illustrated, it can be seen that the clamping spring 10 may also comprise two or more spring layers which are layered one inside the other, for the purpose of increasing the spring force.

Since the contact part 3 is fixed in its position, when the spring is relieved of prestress, the spring force stored thus acts essentially on the frame side wall 22 and causes the frame 20 to be displaced within the housing, which has a corresponding clearance area for this purpose.

In the exemplary embodiment illustrated, a housing free space 37 is provided for this purpose in the housing upper part 33, extends essentially over the entire length of the frame side wall 22 and can be blocked or released as the clearance area. Adjacent to the housing free space 37 and merging with said housing free space 37, the housing upper part comprises a channel or a groove 38, in which an actuating element 40 is held and guided, by means of which the housing free space 37 can be blocked or released as the clearance area.

The actuating element 40 illustrated is guided in a channel 38 which extends parallel to the frame side wall 22. In the state illustrated in FIG. 1, in which the clamping spring 10 is held under prestress, one end 41 of the elongate actuating element 40 protrudes upwards out of the housing upper part 33 through a corresponding opening and acts as a pushbutton. At the end opposite the end 41 acting as the pushbutton, a blocking projection 42 is formed which protrudes into the housing free space 37. A resetting device 43 in the form of a spring device, which is integrally formed on or bears against the blocking projection 42, is provided between the blocking projection 42 and the housing lower part 31. In the state illustrated in FIG. 1, the blocking projection 42 bears against that side of the frame side wall 22 which is opposite the clamping leg 11 and thus blocks the clearance area for the frame 20. This ensures that the clamping spring 10 is held under prestress and the frame 20 is not displaced out of the position illustrated in FIG. 1.

Owing to pressure on the pushbutton 41 of the actuating element 40, the blocking projection 42 is moved out of this blocking position into a release position, in the present example into a position beneath the frame side wall 22, and thus releases the housing free space 37 as the clearance area for the frame 20. As a result, the clamping spring 10 is relieved of prestress, the frame 20 is displaced out of the position illustrated in FIG. 1 in the direction of the clearance area 37 by means of the spring force which is released and, as a result, moves the frame side wall 21 in the direction of the connection section 4, with the result that the inserted conductor cores are clamped in. In one preferred embodiment, the width of the housing free space 37 is dimensioned to be greater than the maximum possible displacement of the frame into this area owing to the connection section 4. In addition, the housing free space 37 expediently has an opening 39 which makes it possible to gain access to the housing free space 37 from the outside.

The manner in which this frame terminal according to the invention functions will be described in more detail below with reference to FIGS. 2 to 4.

The state illustrated in FIG. 2 corresponds to that illustrated in FIG. 1, which also corresponds, for example, to the delivered state, and shows the position of the frame 20, in which the spring 10 is held under prestress. The blocking projection 42 bears against that side of the frame side wall 22 which is opposite the clamping leg 11 and thus blocks the clearance area. The conductor-accommodating area defined between the frame side wall 21 and the connection section 4 has a maximum width, and the clamping spring area formed between the connection section 4 and the frame side wall 22 has a minimum width.

That end 2 of a conductor 1 from which the insulation has been stripped is inserted through the opening 34 in the housing part 33 into the interior of the frame 20 between the frame side wall 21 and the connection section 4 in the direction of the arrow denoted by "A". In order to ensure maximum contact is made, the connection section 4 of the contact part 3 is formed with a contact surface 7 which points in the direction of the frame side wall 21 and expediently extends slightly within the circumferential region predetermined by the conductor insertion opening 34. In order to ensure a clamping region which is as large as possible, the conductor cores or the conductor end from which the insulation has been stripped are expediently passed up to one bearing section 5 of the contact part 3.

Once the conductor 1 to be connected has been inserted, pressure is exerted on the pushbutton 41 in the direction of the arrow denoted by "B" in FIG. 2, as a result of which the blocking projection 42 moves beneath the frame and the spring acting as the resetting device 43 is compressed, as illustrated in FIG. 3.

As can be seen in FIG. 3, this results in, at the same time, the housing free space 37 being released as the clearance area for the frame and the prestress for the clamping spring 10 being released in order to bring the clamping leg 11 into action. As a result, the frame is moved in the direction of the arrow denoted by "C" in FIG. 3.

In the state illustrated in FIG. 3, in which the blocking projection 42 has assumed the release position, the clamping spring 10 thus takes its effect and pushes the frame side wall 22 into the released housing free space 37 by means of the clamping leg 11, the leg 11 being supported on the connection section 4. As a result, the frame side wall 21 opposite the frame side wall 22 is moved towards the connection section 4 in the same direction and thus presses the inserted conductor end 2 against the contact surface 7 of the connection section 4. In this position of the frame 20, the conductor-accommodating area defined between the frame side wall 21 and the connection section 4 thus assumes a minimum width, and the clamping spring area formed between the connection section 4 and the frame side wall 22 assumes a maximum width.

If the width of the housing free space 37 is dimensioned to be greater than the maximum possible displacement of the frame owing to the connection section 4, this means that a maximum clamping force is ensured even in the case of very small conductor diameters.

In order to ensure uniform contact pressure during the displacement of the frame 20 and during clamping of the conductor end 2, the clamping leg 11 is preferably connected to the frame side wall 22 essentially over its entire length or bears against said frame side wall 22 over its entire length.

In order to remove the conductor 1 and/or to produce the prestressed state, the clamping spring 10 needs to be brought into its prestressed position again. For this purpose, as can be seen in FIG. 4, the opening 39 is used, through which a suitable tool, for example a screwdriver, can be passed into the housing free space 37 and brought to bear against the outside of the frame wall 22 in order to move the frame side wall 22 and thus the frame 20 overall out of the clearance area again. If the width of the housing free space 37 is dimensioned to be greater than the maximum possible displacement of the frame owing to the connection section 4, the corresponding insertion of a tool is ensured in a very simple and convenient manner.

If the housing free space 37 is completely released by the frame side wall 22, the actuating element 40, as indicated by the arrow denoted by "E" in FIG. 4, is automatically moved back to its blocking position owing to the resetting device 43 acting on the blocking projection 42, and the blocking projection 42 is thus moved so as to bear against the outside of the frame side wall 22. Then, the conductor 1 can be withdrawn. In addition, the clamping spring 10 is again put under prestress, and the actuating element 40 can be activated again by means of pressure on the pushbutton 41 for the purpose of releasing the blocking position again.

Even the above-described frame terminal according to the invention can be used in various ways, i.e. can be used as a prefabricated element in a whole series of electrical apparatuses in order to act as a screwless connection terminal there. The frame terminal is user-friendly since it can be delivered in the prestressed state and the user only needs to actuate the pushbutton once the conductor has been inserted in order to complete the connection of the conductor. In addition, the insertion of tools for the purpose of tensioning or else releasing the clamping spring within the frame is avoided, with the result that in particular the clamping spring is essentially completely protected against unintentional damage.

Further embodiments according to the invention having an alternative actuating element compared to FIGS. 1 to 4 will be described in particular with reference to FIGS. 5 to 7, said actuating element also having, however, an actuating axis which preferably extends essentially parallel to the conductor insertion axis of the conductor-accommodating area in order, as can already been easily seen from the above-described embodiments, to ensure extremely simple visual checking of the state or the position of an inserted conductor prior to and/or during actuation of the actuating element for the purpose of triggering the clamping action and to make it possible to also use the connection terminal according to the invention in a number of electrical apparatuses, in particular electrical plugging apparatuses, in which free, open access is essentially only provided from the conductor insertion side once the connection terminal has been inserted.

FIGS. 5 to 7 show cut-open views from slightly different viewing angles through a housing, which in turn essentially comprises two insulating housing parts 31 and 33 which can be connected to one another. In these views too, the lower housing part 31 and the upper housing part 33 are shown in a slightly exploded state so as to illustrate the invention. A frame 20 is arranged within the housing, and in turn a clamping spring 10 is held within the interior of said frame 20. The clamping spring 10 shown in FIGS. 5 and 6 has a shape which corresponds to the above-described clamping spring shape, and the clamping spring 10 shown in FIG. 7 has an alternative shape. Each of the clamping springs 10 is in turn arranged in the interior of the frame 20 and is thus surrounded in a protective manner essentially completely by the frame 20 and partially by the housing.

The frame 20 shown in FIGS. 5 to 7 is preferably also a metallic frame 20, which is expediently formed from a stamped sheet-metal part to give a type of sleeve and, as a result, determines a frame interior, in which the clamping spring 10 is arranged and in which a contact part 3 having a connection section 4 and a conductor 1, to be connected to the connection section 4 of the contact part 3, with its exposed conductor cores 2 can be at least partially accommodated.

In the exemplary embodiments shown, the housing comprising the housing parts 31 and 33 with the frame 20, the clamping spring 10 and the contact part 3 is formed as an insert housing in the interior of an external housing 30*a*, 30*b* of an electrical plugging apparatus. Such a preferred electrical plugging apparatus can be seen, for example, in FIGS. 8 and 9 as a further illustration. FIGS. 8 and 9 show an electrical plugging apparatus having an external basic housing or coupling housing 30*a* and an external cover housing or hood 30*b*. The cable is pushed through an opening in the hood, from above through the hood 30*b* in FIG. 9, and the line ends are connected to associated contact parts in the insert housing, which rests in the coupling housing 30*a*. As can clearly be seen in particular in FIG. 8 but also even in FIGS. 1 to 7, a housing comprising the housing parts 31 and 33 can thus also be designed to simultaneously accommodate a plurality of frame terminals. Then, the hood is screwed to the coupling housing and is generally fixed to said coupling housing in the final screwed position by means of detachable latching means. Such contact parts have, for this purpose, a connection section and are formed on the opposite side with a pin-like contact section 8 of the plugging apparatus, as can be seen more clearly in particular in FIG. 6, in the case of a socket-shaped mating contact of a complementary plugging apparatus or with a socket-shaped contact section in the case of a pin-shaped mating contact of a complementary plugging apparatus. However, reference will be made to the fact that, in principle, contact parts can also again be used which have, for example, a contact section within the frame 20. Similarly to the embodiment described previously in connection with FIGS. 1 to 4, the frame 20 shown in FIGS. 5 to 7 also has the shape of a parallelepipedal box, whose upper and lower sides are open in the figures such that the connection section 4 of the contact part 3 and the conductor end 2 to be connected to the contact part 3 reach into the interior of the frame from opposite sides. In addition, the housing upper part side of the housing upper part 33 which essentially closes off the upper open side of the frame 20 in turn has a through-opening 34 for the purpose of inserting and fixing the conductor end 2 to be connected and the expedient positioning tab 36, against which the connection section 4, which has been inserted into the frame interior via the lower side of the frame, bears with its free end. The contact part 3 is thus in turn fixed in the through-opening 32 in the housing lower part 31 at least after the housing upper part 33 and the housing lower part 31 have been assembled, which housing lower part 31, as an alternative, can also be produced together with an external coupling housing, for example.

In the embodiments in FIGS. 5 to 7 too, the connection section 4, in the mounted state, is consequently arranged within the frame 20 such that it is spaced apart from two opposite frame side walls 21 and 22 in order to split the interior of the frame into two separate subareas, the clamping spring area for the purpose of accommodating the clamping spring between the connection section 4 and the frame side wall 21, and the conductor-accommodating area for the conductor to be connected between the connection section 4 and the opposite side wall 22.

In order to further increase the clamping action, the frame side wall 21 has a rib-like surface having edges pointing in the direction towards the conductor to be inserted and provided by bent-out portions 23 in order to be able to hold the conductor in a clamping manner even in the case of relatively high tensile forces on the conductor.

The frame 20 is held between the upper housing part 33 and the lower housing part 31 such that it can be displaced transversely with respect to the connection section 4 and can be moved out of the prestressed position of the clamping spring 10 illustrated in FIGS. 5 and 6 in the direction of the arrow "C" into a clamping position illustrated in FIG. 7 when the clamping action unfolds.

In the position of the frame 20 illustrated in FIGS. 5 and 6, the conductor insertion opening 34 in the housing upper part 33 is essentially located on one axis with the accommodating area between the connection section 4 and the frame side wall 21, the width of the accommodating area and the conductor insertion opening 34 expediently in turn essentially corresponding to one another in order to make it easy to insert or remove the conductor cores 2.

The design of the clamping spring 10 arranged in the clamping spring area as shown in FIGS. 5 and 6 and the manner in which said clamping spring 10 is held essentially correspond to the embodiment described with reference to FIGS. 1 to 4.

The clamping spring 10 arranged in the clamping spring area in the embodiment shown in FIG. 7 comprises, as a modification, a plurality of compression springs, which are aligned parallel to one another, in the form of essentially cylindrical helical springs, the respectively opposite end turns acting as legs 11 and 12. The plurality of helical springs is in this case used to increase the spring force of the clamping spring 10. The end turns acting as spring legs 12 are supported on the connection section 4 of the contact part 3 and thus act essentially as bearing legs. The second end turns virtually acting as clamping legs 11 bear against the frame side wall 22 and are preferably fixed to said frame side wall 22. In order to hold the cylindrical helical springs in a defined manner and in order to counteract the possible incidence of the helical springs bending out when prestressed, centering pins 24, which are integrally formed on the frame side wall 22, extend into the interior of the cylindrical helical springs.

In the embodiments shown in FIGS. 5 to 7 too, the contact part 3 is thus fixed in its position, and the spring force stored consequently brings about a displacement of the frame 20 within the housing in the direction of a clearance area provided in the housing when the clamping spring is relieved of prestress, in which case, in the case of the exemplary embodiments illustrated in FIGS. 5 to 7 too, a housing free space 37 is formed for this purpose in the housing upper part 33, extends at least over the entire length of the frame side wall 22 and can be blocked or released at least partially as the clearance area. Adjacent to the releasable housing free space 37 and merging with said housing free space 37, in turn a type of channel or groove 38' is formed for the purpose of holding and guiding an actuating element 40', with which the housing free space 37 can be blocked or released as the clearance area.

In place of a design and guidance of the actuating element for the purpose of providing an actuating axis defining a "pressure axis", as in the case of the embodiments shown in FIGS. 1 to 4, the actuating element 40' illustrated in the embodiments shown in FIGS. 5 to 7 is guided such that it can rotate in a channel 38', which extends parallel to the frame side wall 22, and thus has an actuating axis, which extends in the same direction as the actuating axis shown in FIGS. 1 to 4, but defines an axis of rotation 46. One end 41' of the elongate actuating element 40' protrudes upwards out of the housing upper part 33 through a corresponding opening and acts as a rotary member, which preferably has an insertion slot for the purpose of introducing a screwdriver. At the end opposite the end 41' acting as the rotary member, as can be seen in FIGS. 5 to 8, a tab 44 can be formed which engages beneath the channel 38' when the actuating element 40 has been inserted into the housing and thus secures the actuating element against it falling out. In turn, a blocking projection 42', which extends transversely from the actuating axis and protrudes into the releasable housing free space 37 in the state shown in FIGS. 5 and 6, in which the clamping spring 10 is held under prestress, is formed on that section of the actuating member 40' which extends away from the end 41 acting as the rotary member. In the embodiments shown in FIGS. 5 to 7, the blocking projection 42' is provided by an eccentric surface arranged or formed on the actuating element 40'. In the state illustrated in FIGS. 5 and 6, the eccentric surface 42' bears against that side of the frame side wall 22 which is opposite the clamping leg 11 and thus blocks the clearance area for the frame 20. As a result, it is ensured that the clamping spring 10 is held under prestress and the frame 20 is not displaced out of the position illustrated in FIGS. 5 and 6.

Owing to the rotation of the actuating member 41' of the actuating element 40' in the direction of the arrow "B'", the blocking projection 42' is moved out of this blocking position about the axis of rotation into a release position, in which the blocking projection 42' is released from the frame side wall and thus releases the housing free space 37 as the clearance area for the frame 20. As a result, the clamping spring 10 is released from the prestress, the frame 20 is displaced out of the position illustrated in FIGS. 5 and 6 in the direction of the clearance area 37 being released owing to the spring force being released and, as a result, the frame side wall 21 moves in the direction of the connection section 4, with the result that the inserted conductor cores are clamped in, as can be seen in FIG. 7. In turn, in one preferred embodiment, the width of the housing free space 37 which can be released as the clearance area is dimensioned to be greater than the maximum possible displacement of the frame into this area owing to the connection section 4. The manner in which a frame terminal according to the invention as shown in FIGS. 5 to 7 functions will be summarized briefly below.

The state illustrated in FIGS. 5 and 6 corresponds, for example, to the delivered state and shows the position of the frame 20, in which the spring 10 is held under prestress. The blocking projection 42' bears essentially flat against that side of the frame side wall 22 which is opposite the clamping leg 11 with the eccentric surface formed on the actuating element 40' and thus blocks the clearance area. The conductor-accommodating area defined between the frame side wall 21 and the connection section 4 has a maximum width, and the clamping spring area formed between the connection section 4 and the frame side wall 22 has a minimum width.

In the direction of the arrow denoted by "A", that end 2 of a conductor 1 from which the insulation has been stripped is inserted through the opening 34 in the housing part 33 into the interior of the frame 20 between the frame side wall 21 and the connection section 4. In order to ensure that maximum contact is made, the connection section 4 of the contact part 3 is formed with a contact surface 7 which points in the direction of the frame side wall 21 and expediently extends slightly within the circumferential region predetermined by the conductor insertion opening 34. In order to ensure a clamping region which is as large as possible, the conductor cores or the conductor end from which the insulation has been stripped are expediently passed up to a bearing section 5 of the contact part 3.

Once the conductor 1 to be connected has been inserted, the rotary member 41' is rotated in the direction of the arrow denoted by "B'" in FIGS. 5 and 6, as a result of which the blocking projection 42' is moved away from the frame about the axis of rotation.

As a result, at the same time the housing free space 37, as the clearance area for the frame, is released and the prestress for the clamping spring 10 is released in order to bring the clamping leg 11 into action. As a result, the frame is moved in the direction of the arrow denoted by "C" in FIGS. 5 and 6.

In the state illustrated in FIG. 7, in which the blocking projection 42' has assumed the release position, the clamping spring 10 thus has its effect and pushes the frame side wall 22 into the released housing free space 37 by means of the clamping leg 11, the leg 11 being supported on the connection section 4. As a result, the frame side wall 21 opposite the frame side wall 22 has been moved in the same direction towards the connection section 4 and thus presses the inserted conductor end 2 against the contact surface 7 of the connection section 4. In this position of the frame 20, the conductor-accommodating area defined between the frame side wall 21 and the connection section 4 thus assumes a minimum width, and the clamping spring area formed between the connection section 4 and the frame side wall 22 assumes a maximum width.

If the releasable width of the housing free space 37 is dimensioned to be greater than the maximum possible displacement of the frame owing to the connection section 4, a maximum clamping force is as a result also ensured in the case of very small conductor diameters.

In order to ensure uniform contact pressure during the displacement of the frame 20 and clamping of the conductor end 2, the frame side wall 22 preferably has a spring force applied to it by the clamping leg(s) 11 over essentially its entire length.

In order to remove the conductor 1 and/or to produce the prestressed state, the clamping spring 10 needs to be brought into its prestressed position again. For this purpose, as can be seen in FIG. 7 as a further modification of the embodiment shown in FIGS. 1 to 4, the rotary member is rotated in the opposite direction in the direction of the arrow "V", with the result that the blocking projection 42' can also be pivoted in this opposite direction about the axis of rotation and can be brought to bear completely against the outside of the frame wall 22 again in order to move the frame side wall 22 and thus the frame 20 overall out of the clearance area again. The actuating element 40' preferably latches into a correspondingly shaped wall section of the housing part 33 in the final position when the frame terminal is completely open.

The conductor 1 can then be withdrawn. In addition, the clamping spring 10 is again put under prestress, and the actuating element 40' can again be activated by actuating the rotary member 41' in order to release the blocking position again.

In the embodiments shown in FIGS. 5 to 7, as a result neither an additional resetting device nor insertion of a suitable tool into the released housing free space is required in order to move the frame 20 overall out of the clearance area again. Compared with the embodiments shown in FIGS. 1 to 4, operability is thus further improved again.

LIST OF REFERENCES

1 Conductor
2 Conductor cores
3 Contact part
4 Connection section
5 Bearing section of the contact part
6 Free end of the connection section
7 Contact surface
8 Contact section
10 Clamping spring
11 Clamping spring end
12 Bearing spring end
13 Tensioning arc
20 Frame
21 Frame side wall
22 Frame side wall
23 Bent-out portion

24 Centering pin
30 External housing of an electrical plugging apparatus
30*a* Coupling housing
30*b* Hood
31 Housing lower part
32 Through-opening in the housing lower part
33 Housing upper part
34 Through-opening in the housing upper part
35 Bearing shoulder of the housing upper part
36 Positioning tab of the housing upper part
37 Housing free space for frame movement
38, 38'Channel for actuating element
39 Opening to the housing free space
40, 40' Actuating element
41 Pushbutton
41' Rotary member
42, 42' Blocking projection
43 Resetting device
44 Tab
46 Axis of rotation

The invention claimed is:

1. A screwless connection terminal having the following features:

a) a contact part (3) having a contact section and having a connection section (4) to which a conductor (1, 2) can be electrically connected;

b) a clamping spring (10);

c) a metallic frame (20) which essentially completely surrounds the clamping spring (10) and is designed to be inserted into insulating housing means (31, 33) of an electrical apparatus, in particular an electrical plugging apparatus, the frame (20) also at least partially accommodating the connection section (4); and d) an actuating element for the clamping spring (10);

wherein the clamping spring (10) has a part or clamping spring end (11) for the purpose of moving the frame (20) in relation to and in a direction transverse to the connection section (4) in order to clamp the conductor (1, 2) to be connected between the frame (20) and the connection section (4), wherein a blocking device (42, 42') in a blocking position holds the frame (20) in a position in which the clamping spring (10) is prestressed, and wherein the actuating element is in the form of a release device (40, 41), which is capable of releasing the blocking position for the frame in order to bring the part or clamping spring end (11) into action.

2. The screwless connection terminal as claimed in claim 1, wherein the clamping spring (10) comprises at least one helical spring, which is essentially cylindrical in the form of a compression spring and of which one end turn acts as a clamping leg (11) and the end turn of the opposite end of the clamping spring acts as a bearing spring leg (12) to be supported on a supporting device arranged in the frame.

3. The screwless connection terminal as claimed in claim 1, wherein the insulating housing means (33) have a bearing shoulder (35), to which a tensioning arc of a clamping spring (10) can be applied in the blocking position.

4. The screwless connection terminal as claimed in claim 1, the metallic frame (20) forming, with the clamping spring (10), one unit which is designed to be inserted in insulating housing means (31, 33) of an electrical apparatus.

5. The screwless connection terminal as claimed in claim 1, wherein the actuating element (40, 40') is held and guided parallel to the side wall (22) of the frame, against which side wall (22) the clamping spring bears.

6. The screwless connection terminal as claimed in claim 1, wherein the blocking device (42, 42') is formed on the actuating element (40, 40').

7. The screwless connection terminal as claimed in claim 1, wherein the blocking projection (42, 42') extends in a direction transverse to the actuating axis of the actuating element (40, 40).

8. The screwless connection terminal as claimed in claim 1, wherein the connection section (4) splits the interior of the frame (20) essentially into two adjacent subareas, an area for accommodating the conductor (1, 2) to be connected and an area in which the clamping spring (10) is arranged.

9. The screwless connection terminal as claimed in claim 1, wherein the actuating element (40) defines a pressure axis as the actuating axis.

10. The screwless connection terminal as claimed in claim 1, wherein the channel (38), which communicates with the housing free space (37), has an opening to the outside and is designed to guide an elongate actuating element, at one of whose ends a projection (42), as the blocking device, reaches into the housing free space (37), said projection (42) being capable, in the blocking position, of holding the frame (20) in a position (20), the other end of the actuating element extending out of the housing in the form of a pushbutton (41) for the purpose of releasing the blocking position, and being capable of tensioning a spring device, which is connected to the housing means (31, 33), when the blocking position is released.

11. The screwless connection terminal as claimed in claim 1, wherein the contact part (3) has a contact section, which is inserted at least partially into insulating housing means (31) outside the frame (20).

12. The screwless connection terminal as claimed in claim 1, the contact part (3) having a contact section which is in the form of a pin or in the form of a socket.

13. The screwless connection terminal as claimed in claim 1, the insulating housing means (31, 33) being designed for the purpose of accommodating a large number of contact parts (3) and clamping springs (10) and frames (20) accommodating said contact parts (3) and said clamping springs (10).

14. The screwless connection terminal as claimed in claim 1, the insulating housing means (31, 33) being in the form of an insert housing within a housing (30*a*, 30*b*) of an electrical apparatus, in particular an electrical plugging apparatus.

15. The screwless connection terminal as claimed in claim 1, wherein, in the blocking position, the blocking device (42, 42') bears against a side wall (22) of the frame, against which side wall (22) the clamping spring end (11) bears, from the opposite side, and wherein the actuating element causes the blocking position to be released by releasing the blocking device (42) from the side wall.

16. The screwless connection terminal as claimed in claim 15, wherein the clamping spring end (11) of the clamping spring (10) bears essentially completely against the side wall (22) of the metallic frame (20).

17. The screwless connection terminal as claimed in claim 16, wherein the clamping spring end (11) of the clamping spring (10) is fixed to the side wall (22) or is formed integrally with said side wall (22).

18. The screwless connection terminal as claimed in claim 1, wherein the insulating housing means (31, 33) have a housing free space (37), which provides a clearance area in which the clamping spring end (11) is capable of moving the frame (20) when the blocking position is released.

19. The screwless connection terminal as claimed in claim 18, wherein the housing free space (37) provides a clearance area having a greater width than the maximum movement possible by the frame in relation to and in the direction transverse to the connection section (4).

20. The screwless connection terminal as claimed in claim 1, wherein the part or clamping spring end (11) is in the form of a leg.

21. The screwless connection terminal as claimed in claim 1, wherein the clamping spring (10) appears to be in the form of a V in longitudinal section, with two legs arranged thereon, with the result that the clamping spring also has, in addition to the clamping spring end (11), a bearing spring end (12) to be supported on a supporting device arranged in the frame.

22. The screwless connection terminal as claimed in claim 21, wherein the supporting device is the connection section (4).

23. The screwless connection terminal as claimed in claim 1, wherein the frame (20) is inserted into insulating housing means (31, 33), which have a conductor insertion opening (34), a housing free space (37) for the intervention of the blocking device and a channel (38), which communicates with the housing free space, for the intervention of the actuating element (40, 40').

24. The screwless connection terminal as claimed in claim 23, the actuating element (40, 40') having an actuating axis which extends essentially parallel to the conductor insertion axis of the conductor insertion opening.

25. The screwless connection terminal as claimed in claim 1, wherein the blocking device (42) is connected to a resetting device (43) for the purpose of resetting the blocking device to the blocking position, and wherein the actuating element causes the resetting device to be tensioned by releasing the blocking device (42).

26. The screwless connection terminal as claimed in claim 25, wherein the housing free space (37) has a tensioning opening (39) for the intervention of a tool for the purpose of moving the frame (20) out of the housing free space in order to tension the clamping spring (10).

27. The screwless connection terminal as claimed in claim 26, wherein the resetting device is arranged between the housing means (31, 33) and the blocking device (42) and causes the blocking device to be reset to the blocking position when the frame (20) has been moved out of the housing free space.

28. The screwless connection terminal as claimed in claim 1, wherein the actuating element (40') defines an axis of rotation as the actuating axis.

29. The screwless connection terminal as claimed in the claim 28, wherein the blocking device (42') forms an eccentric surface in relation to the axis of rotation.

30. The screwless connection terminal as claimed in claim 28, wherein the channel (38), which communicates with the housing free space (37), is formed parallel to the frame side wall (22), has an opening to the outside and is designed to guide an elongate actuating element, one end of the actuating element extending out of the housing as the actuating member (41) for the purpose of rotating the actuating element in order to release the blocking position, in which a projection defining an eccentric surface, as the blocking device, for holding the frame (20) reaches into the housing free space (37).

31. An electrical plugging apparatus comprising a screwless connection terminal having the following features:

a) a contact part (3) having a contact section and having a connection section (4) to which a conductor (1, 2) can be electrically connected;

b) a clamping spring (10);

c) a metallic frame (20) which essentially completely surrounds the clamping spring (10) and is designed to be inserted into insulating housing means (31, 33) of an electrical apparatus, in particular an electrical plugging apparatus, the frame (20) also at least partially accommodating the connection section (4); and d) an actuating element for the clamping spring (10);

wherein the clamping spring (10) has a part or clamping spring end (11) for the purpose of moving the frame (20) in relation to and in a direction transverse to the connection section (4) in order to clamp the conductor (1, 2) to be connected between the frame (20) and the connection section (4), wherein a blocking device (42, 42') in a blocking position holds the frame (20) in a position in which the clamping spring (10) is prestressed, and wherein the actuating element is in the form of a release device (40, 41) which is capable of releasing the blocking position for the frame in order to bring the part or clamping spring end (11) into action.

32. The electrical plugging apparatus as claimed in claim 31, which has an external housing comprising two parts, one housing part being in the form of a coupling housing, and the other housing part being in the form of a cover housing or hood.

33. The electrical plugging apparatus as claimed in claim 32, the insulating housing means being arranged, as an insert housing, in the coupling housing.

* * * * *